US008201973B2

(12) United States Patent
Kudoh et al.

(10) Patent No.: US 8,201,973 B2
(45) Date of Patent: Jun. 19, 2012

(54) FLAME DETECTOR

(75) Inventors: Akihisa Kudoh, Tokyo (JP); Kazuyoshi Sakurai, Tokyo (JP); Hiroshi Kaneko, Tokyo (JP); Nobuyuki Akiyama, Tokyo (JP); Masahiro Katagiri, Tokyo (JP)

(73) Assignee: Lixil Nittan Company, Limited, Tokyo (JP)

( * ) Notice: Subject to any disclaimer, the term of this patent is extended or adjusted under 35 U.S.C. 154(b) by 486 days.

(21) Appl. No.: 12/561,185

(22) Filed: Sep. 16, 2009

(65) Prior Publication Data

US 2010/0073926 A1 Mar. 25, 2010

(30) Foreign Application Priority Data

Sep. 19, 2008 (JP) ..... 2008-241097

(51) Int. Cl.
*F21V 33/00* (2006.01)

(52) U.S. Cl. ..... 362/253; 362/276; 362/602

(58) Field of Classification Search ..... 362/235, 362/253, 276, 602; 250/352
See application file for complete search history.

(56) References Cited

U.S. PATENT DOCUMENTS

| | | | | |
|---|---|---|---|---|
| 6,300,876 | B1 | 10/2001 | Sakurai | |
| 6,469,625 | B1 * | 10/2002 | Tomooka | 250/352 |
| 8,066,392 | B2 * | 11/2011 | Wang | 362/276 |
| 2007/0091597 | A1 * | 4/2007 | Wang et al. | 362/235 |

FOREIGN PATENT DOCUMENTS

| | | |
|---|---|---|
| EP | 1 049 061 | 2/2000 |
| EP | 2 028 631 | 2/2009 |
| JP | 2001-283345 | 10/2001 |
| JP | 2005-122437 | 5/2005 |

* cited by examiner

*Primary Examiner* — Y My Quach Lee
(74) *Attorney, Agent, or Firm* — Dickinson Wright PLLC

(57) ABSTRACT

A flame detector is provided. A circuit board is disposed in a housing. A first light source emits first light. A light guide member comprised of translucent material guides the first light from the first light source to a light emission portion of the light guide member. A first light receiving element detects second light having a predetermined wavelength unique to the flames. A second light source emits third light to a translucent cover which is disposed between an opening of the housing and the first light receiving element. A second light receiving element detects the third light passed through the translucent cover to test the translucency. The first light source, the second light source and the second light receiving element are mounted on the circuit board. The light emission portion is formed into a substantially annular shape which encloses the first light receiving element at a front side of the housing to limit a field of view of the first light receiving element to a predetermined range. And the light guide member has a light entrance portion and a light exit portion for the third light to form a light path from the second light source to the second light receiving element through the translucent cover and the light guide member.

9 Claims, 12 Drawing Sheets

FLAME DETECTOR

The disclosure of Japanese Patent Application No. 2008-241097 filed on Sep. 19, 2008 including specification, drawings and claims is incorporated herein by reference in its entirety.

BACKGROUND

The present invention relates to a flame detector that performs detection of flames by capturing light having a wavelength unique to flames.

A related-art flame detector has a main detection light-receiving element that receives infrared radiation from a front aperture of a housing, to thus detect flames; a light-receiving window made up of a transmission plate that is positioned in front of the main detection light-receiving element and that permits transmission of infrared radiation; a test light source that illuminates test light for detecting stains on the light-receiving window; a test light-receiving element that receives the test light passed through the light-receiving window, to thus determine the degree of the stains on the light-receiving window; and an operation indicator lamp that becomes illuminated at the front side of a housing (see; for instance, JP-A-2005-122437).

A requirement for the flame detector is that the operation indicator lamp should be readily and clearly visible from all directions with reference to a center line (a direction perpendicular to the front) of the detector. Accordingly, the related-art flame detector has a floodlight window forwardly projecting from a vertex portion of a front head of a housing, and the window receives inside light from the light emitting element serving as a main light source and provides a luminous indication to the outside.

Due to this structure, in the related-art flame detector, the operation indicator lamp is positioned on one side with reference to the center of the front of the housing. Therefore, the related-art flame detector has a problem that the visibility from the other side is not good.

Further, in order to even slightly improve omnidirectional visibility, the operation indicator lamp must be projected from the front of the housing. Accordingly, the indicator lamp becomes thick in its front-to-back direction, which in turn raises a problem of an increase in the overall size of the detector in its front-to-back direction.

In order to receive light of predetermined wavelength from the outside, the light receiving part of the main detection light receiving element for flame detection used in the flame detector must be arranged so as to oppose the front and be able to receive light. In order to enable stable detection of flames at all times, deterioration of detection accuracy, which would otherwise be caused by satins on a translucent plate that is to serve as a cover for the main detection light receiving element, must be monitored. In this regard, in the related-art flame detector, a concave portion is provided in the front of the housing, the test light source is disposed inside an inner wall of the concave portion, test light is emitted from the test light source on a test light receiving element disposed inside the floodlight window, and stains on the translucent place are monitored by the quantity of light received.

However, in the above stain detection structure, the test light must be emitted from a position ahead of the translucent window. The test light source must be positioned distant from a circuit board placed in the vicinity of an interior rear side of the housing. Further, a connection with the circuit board by way of a socket and supporting of legs of the element by a member that supports the legs in an extended manner are required. An increase in the number of components and deterioration of productivity of the flame detector are therefore brought about.

SUMMARY

It is therefore an object of at least one embodiment of the present invention to reduce the number of components while fulfilling demands for a flame detector, such as visibility and miniaturization.

In order to achieve the above described object, according to an aspect of at least one embodiment of the present invention, there is provided a flame detector comprising: a housing formed with an opening at a front side thereof; a circuit board disposed in the housing and having a circuit for detecting flames; a first light source mounted on the circuit board and configured to emit first light; a light guide member having a light emission portion, the light guide member comprised of translucent material and configured to guide the first light from the first light source to the light emission portion by internal propagation thereof to emit the first light from the light emission portion ahead of the housing; a first light receiving element configured to detect second light having a predetermined wavelength unique to the flames from the opening; a translucent cover interposed between the opening and the first light receiving element; a second light source configured to emit third light to the translucent cover; and a second light receiving element configured to detect the third light passed through the translucent cover to test the translucency of the translucent cover, wherein the second light source and the second light receiving element are mounted on the circuit board, wherein the light emission portion is formed into a substantially annular shape which encloses the first light receiving element at the front side of the housing to limit a field of view of the first light receiving element to a predetermined range, and wherein the light guide member has a light entrance portion and a light exit portion for the third light to form a light path from the second light source to the second light receiving element through the translucent cover and the light guide member.

Since the light emission portion is formed into a substantially annular shaped which encloses the first light receiving element at the front side of the housing and serves a field of view limitation function, it is not necessary to protrude the light emission portion from the front side of the flame detector. Accordingly, the thickness of the flame detector can be reduced in a front-to-back direction (a direction orthogonal to the front of the housing), and the flame detector can be miniaturized. Here, the word "substantially annular" is not limited to a circle but means an endless continual shape capable of enclosing the first light receiving element. Further, since this light emission portion serves the field of view limitation function, it is preferable that the light emission portion is formed into a shape made up of lines and curves and having no corners.

Visibility from every direction is ensured by forming the light emission portion into the substantially annular shape. Therefore, the light emission portion does not need to protrude from the front side of the flame detector, and the thickness of the flame detector can be reduced in a front-to-back direction (a direction orthogonal to the front of the housing), and the flame detector can also be miniaturized.

Moreover, since the light guide member has a light entrance portion and a light exit portion, the light guide member can receive the third light at the light entrance portion from the second light source and emit the third light from the light exit portion to the second light receiving element. By forming the light path in which the translucent cover is interposed between the second light source and the light guide member or between the light guide member and the second light receiving element, the translucency of the translucent cover can be tested. As a result, it becomes unnecessary to place either the second light source or the second light receiving element at a position further distant from the circuit board relative to the translucent cover, and hence it is not necessary to provide a connection with the circuit board by a socket or a support. Therefore, the number of components can be reduced.

The light guide member implements various functions, such as the light emission function of the first light (the display lamp), the function for limiting the field of view of the first light receiving element, and the function for creating the light path for the third light (the test light) by means of a single member. Even from this viewpoint, the number of components is reduced, and productivity of the flame detector can be enhanced.

An entire inner periphery of the annularly shaped light emission portion may be formed with an inner slope inclined toward the first light receiving element to emit the first light from the inner slope.

Since the first light is emitted from the inner slope formed along the inner periphery of the annularly shaped light emission portion of the light guide member to the outside of the housing, an illuminated state of the light emission portion becomes easy to view from the range of the field of view of the first light receiving element, so that it becomes possible to enhance visibility. Namely, a displayed state of a display lamp can be reliably ascertained from the range where the flames are monitored, so that an operating display can be provided appropriately for the objective.

Further, visibility from regions (S' and S' in FIG. 13) other than the monitoring area (S in FIG. 13) can also be assured, and the illuminated state can be viewed from substantially every direction centering on the first light receiving element.

The light guide member may be provided with a first light guide portion extended from the annularly shaped light emission portion toward the outside thereof and a second light guide portion extended from the first light guide portion toward the first light source, and a connection portion between the first light guide portion and the second light guide portion may be disposed to be hidden by the housing.

The connection portion between the first light guide portion and the second light guide portion of the light guide member sometimes becomes brighter than the environment by means of the first light that rectilinearly travels along the second light guide portion without propagating to the first light guide portion. However, since the connection portion between the first light guide portion and the second light guide portion is arranged so as to become hidden in the housing, a phenomenon of the light emission portion of the light guide member being unevenly illuminated can be prevented, and the overall light emission portion can be illuminated more uniformly.

The first light guide portion may have a flat plate shape, a rear face of the light emission portion, which is opposite to a front face from which the first light is emitted and one face of the first light guide portion may be flush with each other, and the rear face of the light emission portion and the one face of the first light guide portion may be formed with a minute structure portion including a plurality of minute grooves or minute projections.

Since the minute structure portion made up of a plurality of minute grooves or minute projections is formed on the rear face of the light emission portion, which is opposite to a front face from which the first light is emitted and one face of the first light guide portion (hereinafter called "rear surfaces"), scattered light that propagates along the rear surfaces can be induced, and an illumination effect resultant from scattering can be exhibited at a side of a light emission face (the front face). As a result, the light emission face can be illuminated much brighter.

The first light guide portion may be formed with a V-shaped notch at a position opposed to one end of the second light guide portion, the V-shaped notch having two reflection faces configured to reflect the first light propagating along the second light guide portion to a direction along a flat surface of the first light guide portion, and an opening angle of the V-shaped notch may be greater than 90° and equal to or smaller than 95°.

The V-shaped notch having the opening angle greater than 90° is formed at a position where the first light guide portion is opposed to the one end of the second light guide portion. Therefore, when compared with a case where the open angle is precisely 90°, scattering induced by the minute structure portion formed on the rear surfaces can effectively be induced, so that the light emission face can be illuminated much brighter. Further, when the opening angle of the V-shaped notch is made greater than 95°, an effect of propagating light to a location further distant from the second light guide portion is deteriorated, the quantity of light escaping to the outside from a bottom surface is increased, and thus the effect for illuminating the light emission face much brighter may be deteriorated. Therefore, the open angle is preferably 95° or less.

An entire outer periphery of the annularly shaped light emission portion may be formed with an outer slope so that a cross section of the annularly shaped light emission portion is formed into a mound shape.

The outer slope is formed along the outer periphery of the substantial annularly shaped light emission portion in such a way that a cross section of the substantially annularly shaped light emission portion of the light guide member is formed into a mound shape. If an end face extending along the front-to-back direction is made in place of the outer slope along the entire outer periphery of the substantially annularly shaped light emission portion, both the bottom surface and the end face extending along the front-to-back direction are clearly seen through the inner slope when the illuminated light guide member is viewed from the inner slope. An area of the end face that is viewed through the slope and that extends along the front-to-back direction becomes darker than an area of the bottom surface viewed through the slope, whereupon the illuminated state of the inner slope becomes uneven. Accordingly, the area that is viewed through the inner slope can be limited substantially, solely to the bottom surface by providing the outside of the substantially annular area with a slope surface, so that the illuminated state of the inner slope can be made uniform.

An outer peripheral face of the annularly shaped light emission portion is formed with the minute structure portion.

The minute structure section is formed on the outer peripheral face of the substantially annularly shaped light emission portion of the light guide member. If the minute structure section is not provided on the outer peripheral face of the substantially annularly light emission portion, when the illuminated light guide member is viewed from the inner slope, the outer peripheral face that is viewed through the inner slope becomes darker than the area of the bottom surface, whereupon the illuminated state of the inner slope becomes uneven. Accordingly, the area that is clearly seen through the inner slope can be made uniformly bright by providing the outer peripheral face with the minute structure portion, so that the illuminated state of the inner slope can be made further uniform.

The outer peripheral face refers to an outer side surface of the substantially annularly shaped light emission portion along its center.

The flame detector may further comprise a first support configured to fix the first light receiving element with respect to the circuit board; and a second support configured to fix the light guide member with respect to the circuit board, wherein the translucent cover may be fixedly sandwiched between the first support and the second support and the first support and the second support may be fixed with respect to the circuit board.

The translucent cover is fixedly sandwiched between the first support and the second support, and the first and second supports can be fixed with respect to the circuit board. So long as these configurations are assembled on the circuit board, detection of light having a predetermined wavelength can be tested, in the same environment as that achieved in actual usage, while the field of view of the light guide member is limited and while the third light is caused to pass through the translucent cover. A translucency test is made possible without involvement of operation for opening and closing the housing, so that load on test operation can be lessened.

The first light receiving element may include an infrared detection element provided with a heat source, the heat source may produce heat to run a self-test for detection function of the infrared detection element.

The infrared detection element is provided with a heat source; and detection function of the infrared detection element can be tested by heating the heat source. Hence, an anomaly in the element can readily be detected, and occurrence of a detection failure can effectively be reduced.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 3A, 3B and 3C are functional descriptive views of a monitoring area confirmatory mark, wherein FIG. 3A shows a mutual positional relationship between a main detection light receiving element and the monitoring area confirmatory mark achieved when viewed from the front of the flame detector, FIG. 3B shows a mutual positional relationship achieved when the mark and the element are viewed from a position slightly displaced from the front in a Y-axis direction within the monitoring area, and FIG. 3C shows a mutual positional relationship achieved when the element and the mark are viewed from a position displaced outside the monitoring area;

DETAILED DESCRIPTION OF THE EMBODIMENTS (General Configuration of a Flame Detector)

Figure 1:
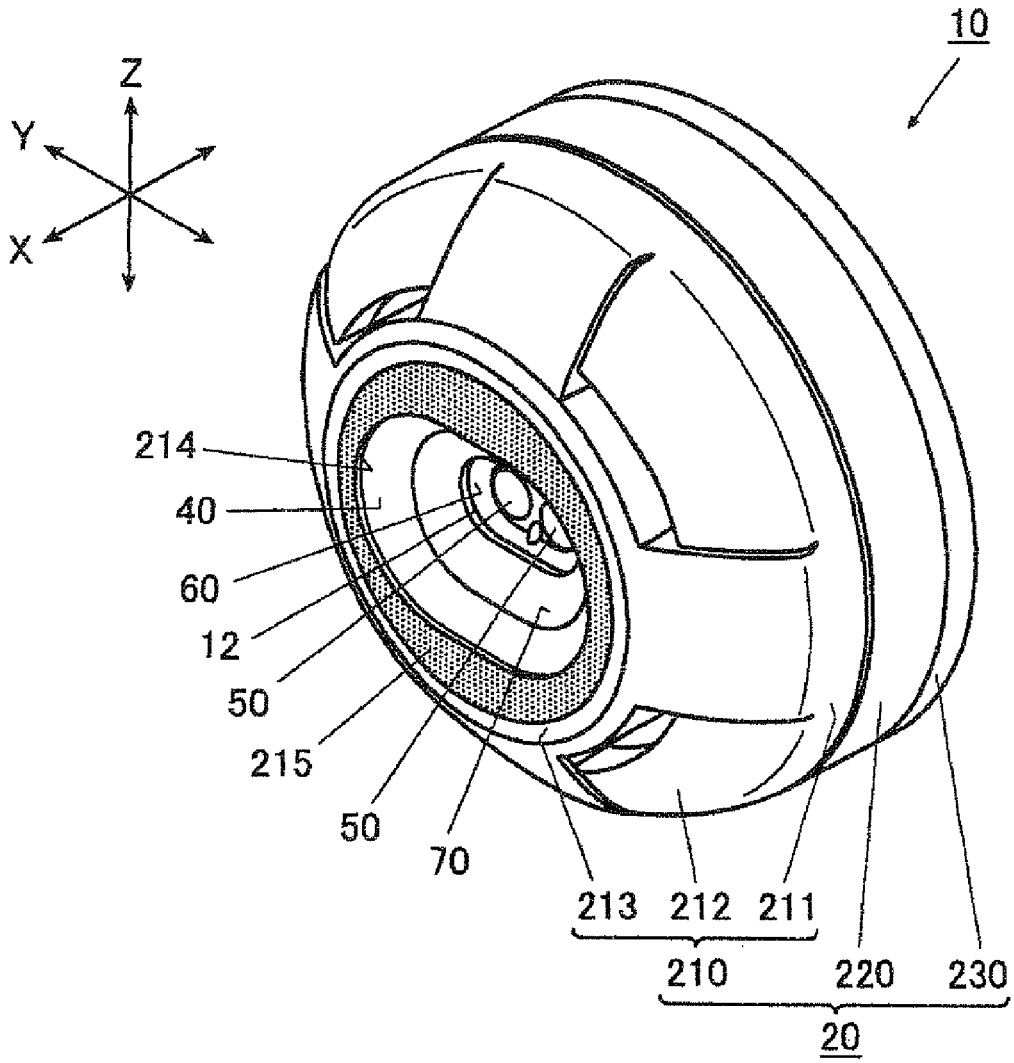
FIG. 1 is a perspective view of a flame detector of an embodiment of the present invention.
Figure 2:
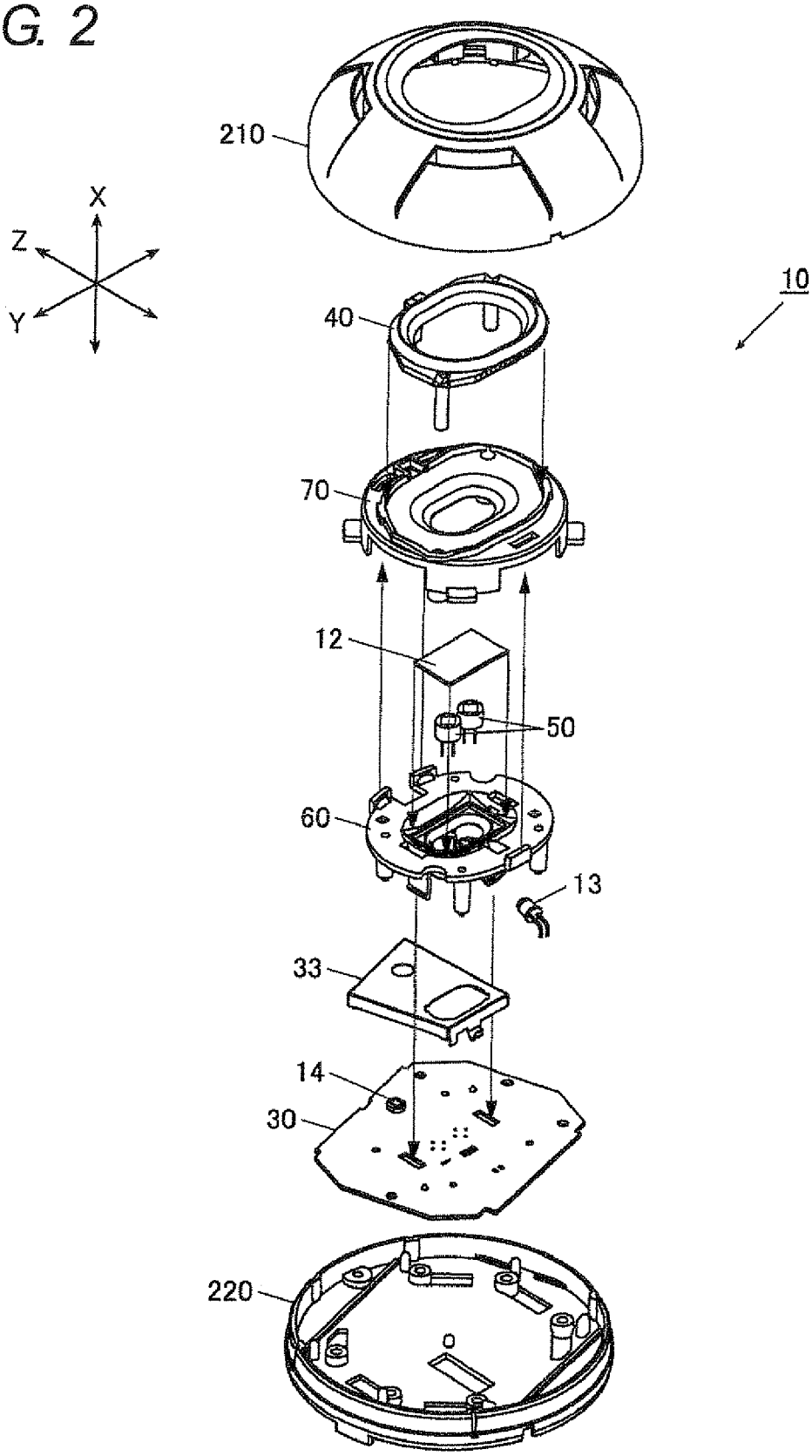
FIG. 2 is an exploded perspective view of the flame detector.

A flame detector 10, which is an embodiment of the present invention, will be described by reference to FIGS. 1 through 14B. FIG. 1 is a perspective view of the flame detector 10, and FIG. 2 is an exploded perspective view of the same.

In general, the flame detector 10 is fixedly mounted with its rear side upward and intended for detecting flames in a region ahead of its front side (i.e., a lower region achieved in a mounted state) while its front side remains downwardly oriented. Such a flame detector 10 is connected to an unillustrated receiver that centrally manages a plurality of flame detectors disposed above an area to be monitored. Upon detection of flames, the flame detector transmits a detection signal to the receiver.

In the following descriptions, for the sake of convenience, directions of the flame detector 10 are defined as follows. Specifically, a direction from the front side to the rear side of the flame detector 10 is taken as an X-axis direction. The flame detector 10 has two main detection light receiving elements 50 and 50, and the main detection light receiving elements are disposed while arranged in a given direction orthogonal to the X-axis direction. In the following descriptions, the direction along which the main detection light receiving elements 50 and 50 are arranged is referred to as a Y-axis direction. Moreover, a direction to which both the X-axis direction and the Y-axis direction are orthogonal is referred to as a Z-axis direction (see FIG. 1). On occasion, an area ahead of the front of the flame detector 10 is referred to as a "front side," and a rear surface side of the same is referred to as a "rear side."

The flame detector 10 has a housing 20; a circuit board 30 that is arranged in the housing 20 and in which circuit for detecting flames is fabricated; a main light source 11 connected to the circuit board 30; a light emission section 410 that emits light from the front of the housing 20; a light guide member 40 made up of a translucent material for guiding light from the main light source 11 to the light emission section 410 by means of internal propagation; a main detection light receiving element 50 that receives light of predetermined wavelength originated from flames by way of an opening 214 formed in the front side of the housing 20; a translucent cover 12 that is interposed between the opening 214 and the main detection light receiving element 50 and that permits transmission of light from the outside; a test light source 13 that radiates test light on the translucent cover 12; a test light receiving element 14 that receives the test light passed through the translucent cover 12; an element support 60 that fixes the orientation of the main detection light receiving element 50 to the circuit board 30; and a guide support 70 that fixes the light guide member 40 with respect to the circuit board 30.

(Housing)

The housing 20 has a cover element 210 located closest to the front side; a main element 220 that stores and holds the circuit board 30, and the like; and a base element 230 whose rear surface side is fixed to an installation position. All of the elements are made of a white resin.

The base element 230 is formed into the shape of a circular dish centering on the X-axis direction. The rear surface side of the base element is fixedly mounted at the installation position while oriented upwardly. Wiring is provided on the rear surface side, whereby the base element 230 is connected to a receiver.

The main element 220 assumes the shape of a body of revolution substantially centering on the X-axis direction; namely, the shape of a closed-end cylindrical element whose outer diameter is slightly smaller than that of the base element 230. The main element 220 is attached so as to fit into the base element 230 while a rear surface side of a bottom plate of the main element opposes the base element 230. A plurality of unillustrated connection terminals are provided on the rear surface side of the bottom plate of the main element 220, and extremities of the respective connection terminals are made in a hook shape. Specifically, each of the connection terminals has a function of fixing the main element 220 to the base element 230 by means of a hook-shaped section engaging with an engagement recess provided on the base element 230. The respective connection terminals are connected to the circuit board 30 by means of wiring and can receive a power supply from the base element 230 and exchange signals with the receiver by means of the engagement with the base element 230.

The cover element 210 is a body of revolution substantially centering on the X-axis direction and is made up of a cylindrical section 211, a truncated cone section 212 continually connected to a front-side end of the cylindrical section 211, and a front end face section 213 continually connected to a front-side end of the truncated cone section. These sections are integrally molded.

An outer diameter of the cylindrical section 211 is set equal to an outer diameter of the base element 230, and a backside end of the cylindrical section 211 is widely opened. The main element 220 is fitted into the end of the opening, to thus be coupled by means of screw engagement.

Figure 3A:
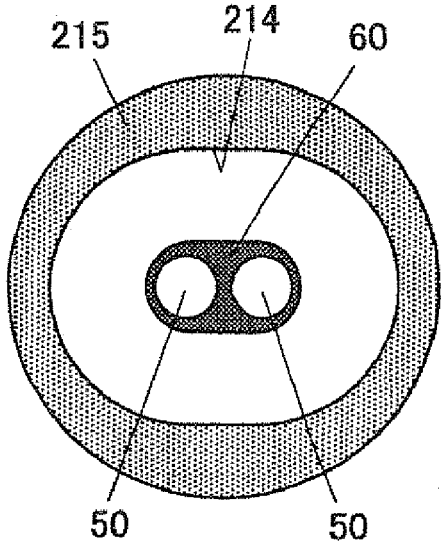
Figure 3B:
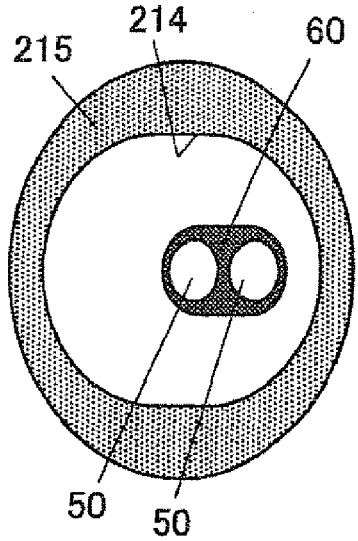
Figure 3C:
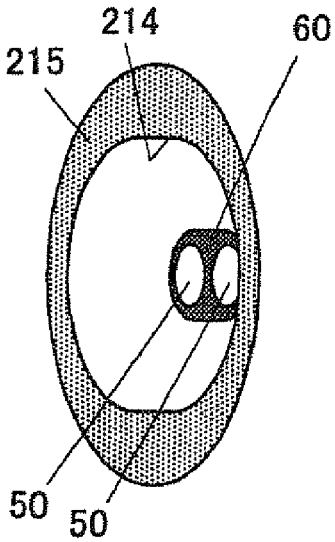

A large opening 214 with an oval shape (a shape defined as a result of respective ends of semicircular arcs being connected together by means of straight lines) is made at the center of the front end section 213, and a longitudinal direction of the oval opening is aligned with the Y-axis direction. A circular, black monitoring area confirmatory mark 215 is provided so as to enclose the opening 214. The main detection light receiving elements 50 are arranged at the center of the opening 214 and on a deep backside within the monitoring area confirmatory mark 215. The inside of a range defined by extensions of straight lines, which connect the circumference of the main detection light receiving element 50 to respective areas that are present along an inner edge of the monitoring area confirmatory mark 215, serve as an angular field of view; namely, a monitoring area, of the main detection light receiving element 50. FIG. 3A shows a positional relationship between the main detection light receiving element 50 and the monitoring area confirmatory mark 215 when viewed from the front of the flame detector 10. FIG. 3B shows a positional relationship between the main detection light receiving element 50 and the monitoring area confirmatory mark 215 when viewed from the front at a position in the monitoring area slightly displaced in the Y-axis direction. FIG. 3C shows a positional relationship between the main detection light receiving element 50 and the monitoring area confirmatory mark 215 when viewed from the front at a position displaced outside the monitoring area in the Y-axis direction. As shown in the drawings, as the viewing position becomes displaced from the center of the monitoring area, a space between an inner edge of the monitoring area confirmatory mark 215 and the center of an element support 60 of the main detection light receiving area 50, which will be described later, becomes gradually smaller. When the viewing position is displaced outside the monitoring area, the space completely disappears. Specifically, when the flame detector 10 is set on a ceiling, or the like, it is possible to check whether or not a user's position is located in the monitoring area, on the basis of presence/absence of the space made by the monitoring area confirmatory mark 215. The embodiment illustrates an example in which the user's position is displaced in the Y-axis direction. However, the same also applies to a case where the user's position is displaced in the Z-axis direction or a composite direction consisting of the Y-axis and Z-axis directions.

A storage space for storing the principal configuration of the flame detector 10 is made between the cover element 210 and the main element 220. As shown in FIG. 2, the circuit board 30, a board cover 33, the element support 60, the main detection light receiving elements 50, the translucent cover 12, the guide support 70, and the light guide member 40 are sequentially mounted on the front side of the bottom of the main element 220 within the storage space.

(Main Detection Light Receiving Element)

An infrared sensor (e.g., a piezoelectric element) is used for the main detection light receiving element 50. Infrared radiation emitted from flames resultant from combustion exhibits a characteristic of an abruptly-rising peak appearing at a wavelength of a 4.4 [μm] infrared range for reasons of a phenomenon called $CO_2$ resonance radiation. Flames are detected by means of whether or not a peak of 4.4 [μm] can be detected by use of two main detection light receiving elements; namely, the main detection light receiving element 50 made up of an infrared sensor equipped with a filter for permitting transmission of the light of a 4.4 [μm] wavelength and the main detection light receiving element 50 made up of an infrared sensor equipped with a filter for permitting transmission of light having a wavelength higher or lower than 4.4 [μm] (e.g., a wavelength of 4.0 or 5.0 [μm]). In each of the main detection light receiving elements 50 and 50, lead wires of the element are fixed to the circuit board 30 by soldering. Further, the two main detection light receiving elements 50 and 50 are supported by the element support 60 to be described later and arranged in proximity to each other and side by side along the Y-axis direction while their detection planes are oriented toward the front side. Correspondingly, the front opening 214 of the previously-described cover element 210 is also formed in an oval shape that extends along the Y-axis direction and that can simultaneously encompass two circles arranged side by side in close proximity to each other.

Each of the main detection light receiving elements 50 has an unillustrated, built-in heat emitting element that is provided in the sensor, the heat emitting element is also connected to the circuit board 30. The light emitting elements are intended to be used for self-testing the main detection light receiving element 50. The circuit board 30 performs control operation for carrying out a self-test. When the circuit board 30 has received a diagnosis performance command from the receiver or when a built-in timer periodically detects diagnosis timing, the circuit board applies power to a heater element, thereby heating the heater element. Infrared radiation originating from the heater element is detected by the main detection light receiving elements 50. Depending on whether or not predetermined intensity of an infrared radiation detection signal from the main detection light receiving element 50 is acquired, the circuit board 30 carries out a diagnosis about whether or not the element is in normal operation. When the element is determined to be anomalous as a result of diagnosis, the anomaly in the main detection light receiving element 50 is transmitted to the receiver. Specifically, the flame detector 10 can perform self-diagnostic function of the main detection light receiving elements 50 by means of the circuit board 30 and the heater element.

(Translucent Cover)

The translucent cover 12 is a rectangular flat plate that is placed in front of the two main detection light receiving elements 50 and 50 and that is made of transparent sapphire glass that permits transmission of infrared light. The translucent cover 12 is intended for protection purpose in such a way that light receiving planes of the respective main detection light receiving elements 50 and 50 or an optical filter is prevented from becoming exposed directly to the outside, to thus be susceptible to hand contact, stains, or fractures.

(Element Support)

Figure 4:
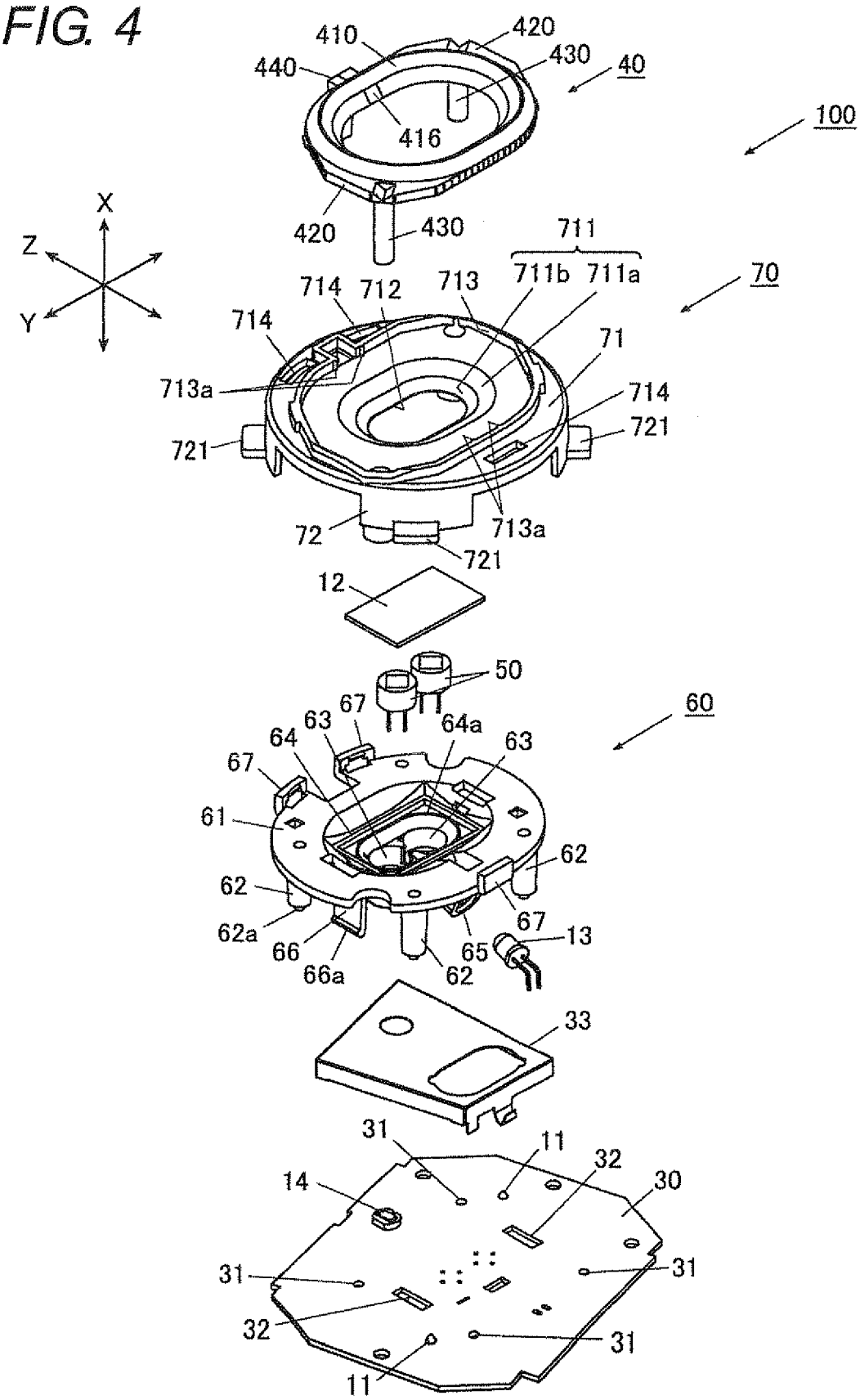
FIG. 4 is an exploded perspective view showing a flame detection unit stored in a housing.
Figure 5:
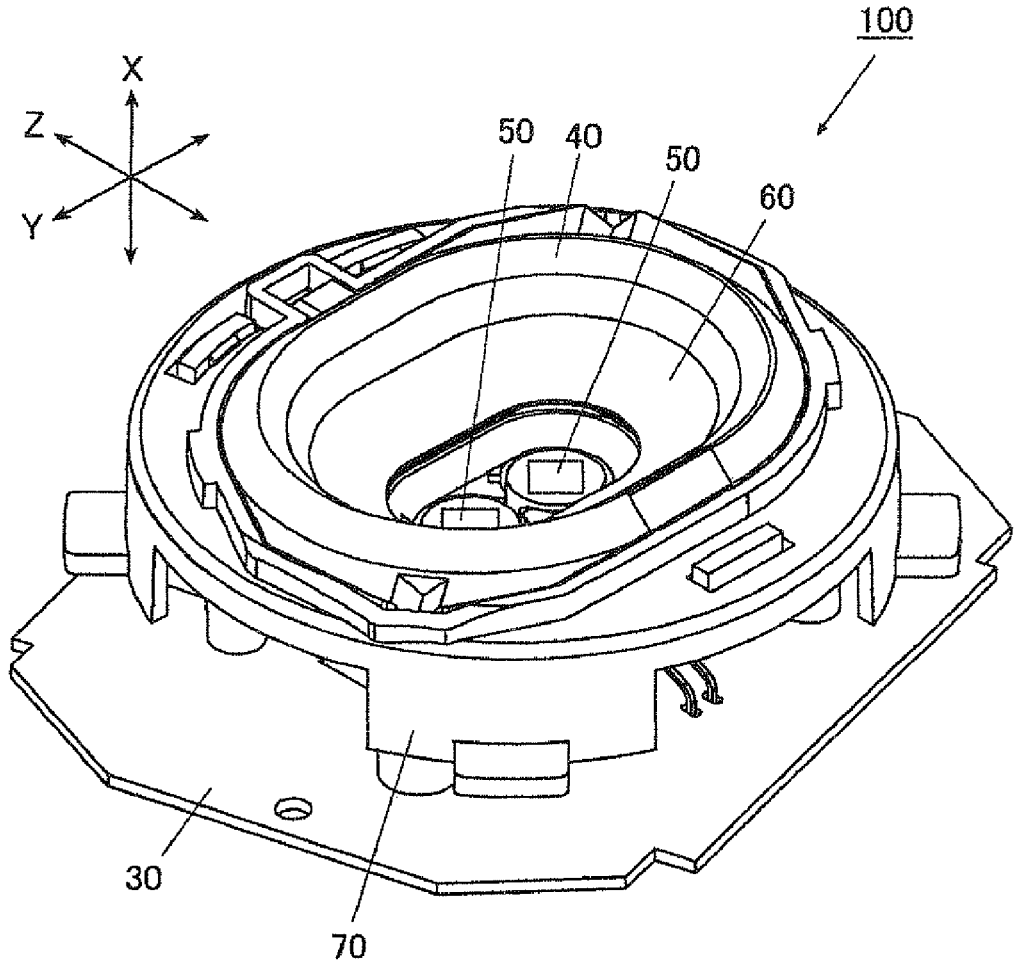
FIG. 5 is a perspective view of an assembled flame detection unit.
Figure 6:
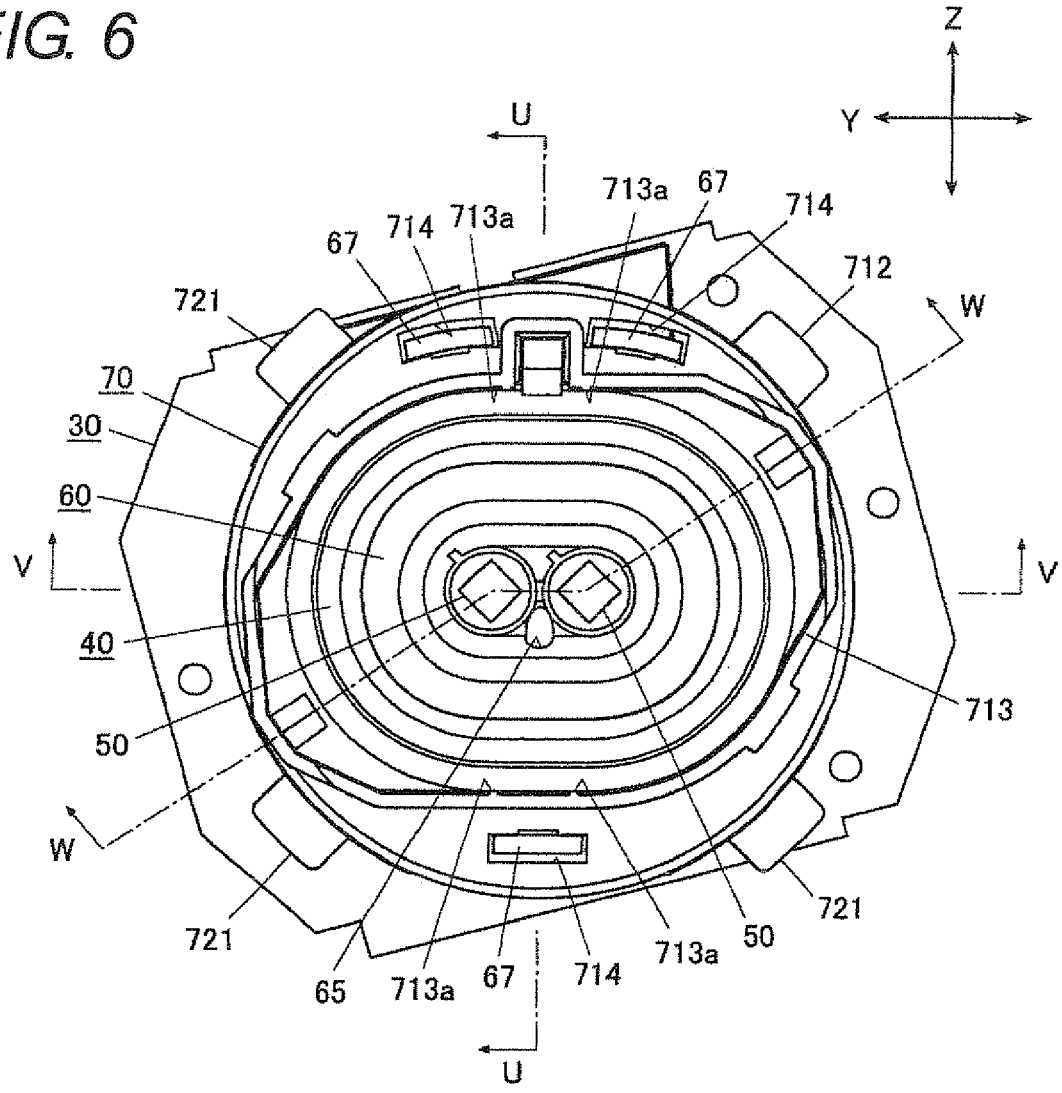
FIG. 6 is a plan view showing the flame detection unit having the structure shown in FIG. 5.
Figure 7:
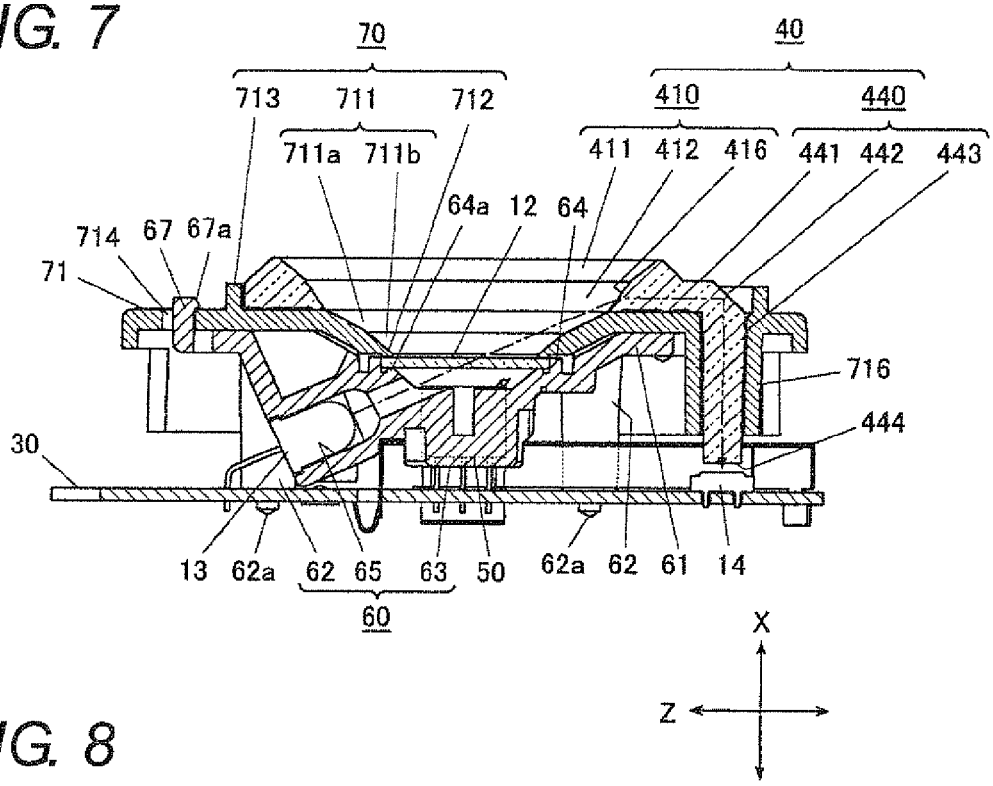
FIG. 7 is a cross-sectional view taken along line U-U shown in FIG. 6.
Figure 8:
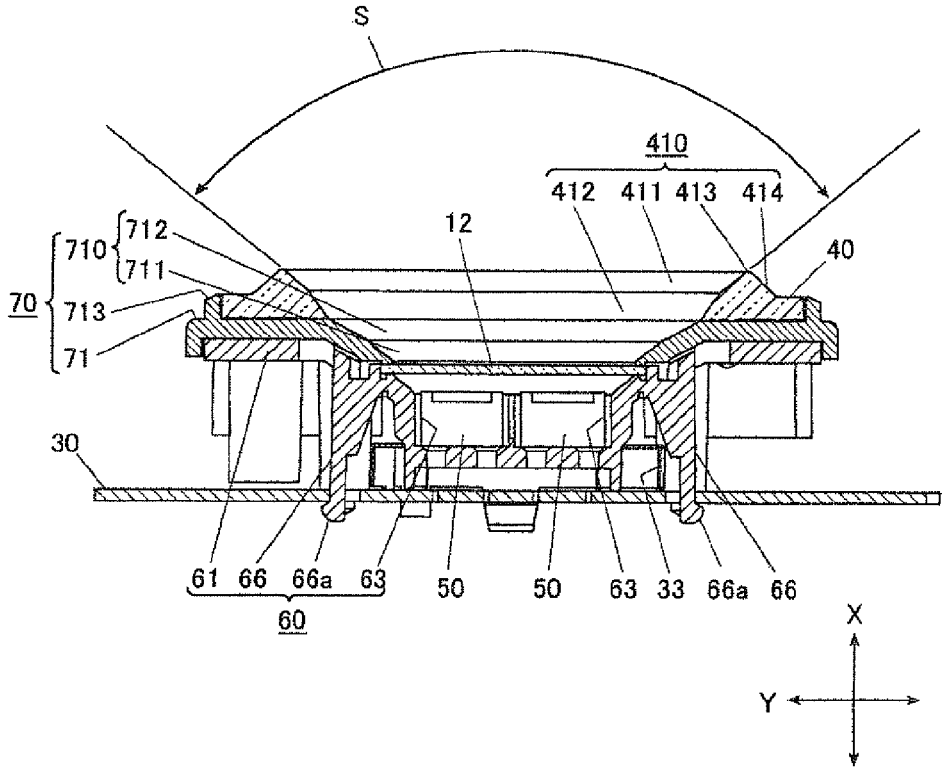
FIG. 8 is a cross-sectional view taken along line V-V shown in FIG. 6.
Figure 9:
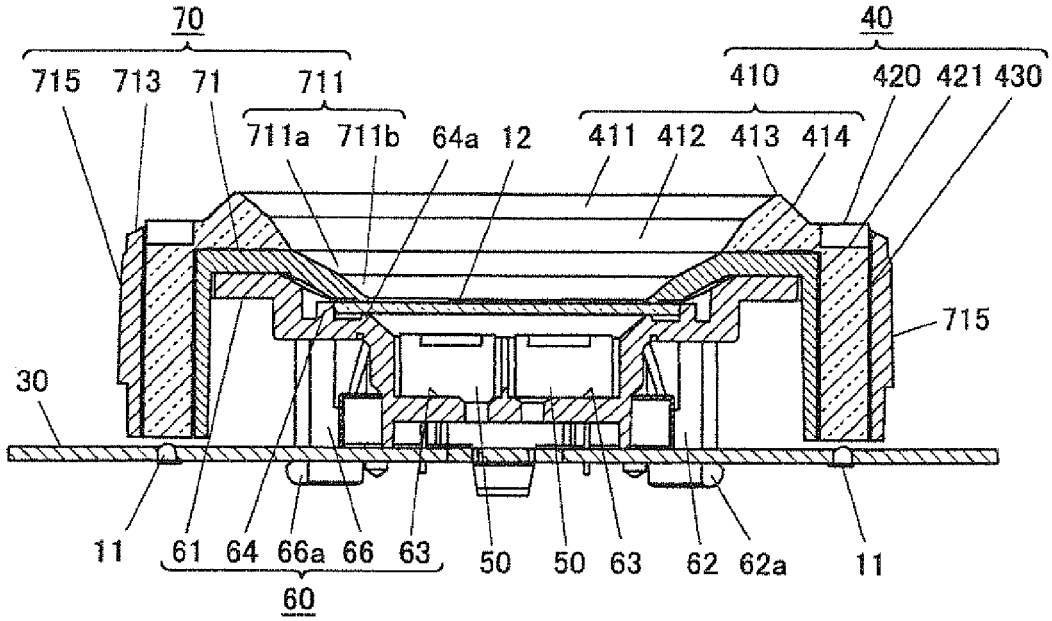
FIG. 9 is a cross-sectional view taken along line W-W shown in FIG. 6.

FIG. 4 is an exploded perspective view showing a flame detection unit 100 stored in the housing 20; FIG. 5 is a perspective view showing only a configuration to be stored in the housing 20; FIG. 6 is a plan view of the configuration shown in FIG. 5; FIG. 7 is a cross sectional view taken along line U-U shown in FIG. 6; FIG. 8 is a cross sectional view taken along line V-V shown in FIG. 6; and FIG. 9 is a cross sectional view taken along line W-W shown in FIG. 6.

As shown in FIGS. 4 through 9, the element support 60 has a substantially-oval pedestal 61 extending in the Y-axis direction when viewed from its front; and four pillars 62 (one or two of them are omitted from the drawings) extending downwardly from the back of the pedestal 61 along the X-axis direction. The element support 60 is integrally formed from a black resin.

The four pillars 62 are provided at respective four corners of the pedestal 61. Bosses 62*a*, which are smaller than the pillar 62 in terms of a diameter, further extend from leading end faces of the respective pillars 62. Holes 31 for receiving the respective bosses 62*a* are made in the circuit board 30.

The pedestal 61 is arranged along the Y-Z plane, and an indentation is made in the center of the pedestal. Two element housing recesses 63 and 63 are made in the center of the indentation along the Y-axis direction. The front side of each of the element housing recesses 63 and 63 is opened and made into a shape that allows fitting of a cylindrical body commensurate with the shape of the element. Four through holes that permit penetration of leads of the main detection light receiving element 50 are formed in the bottom of each element housing recess. By means of the element housing recesses 63, the main detection light receiving elements 50 are fixed in directions suitable for detecting flames while oriented toward the front side.

A translucent cover hold section 64 assuming the shape of a rectangular frame when viewed from its front is provided ahead of the respective element housing recesses 63 and 63 and within the center indentation of the pedestal 61, and a rear support section 64*a* that contacts the translucent cover 12 from behind and that assumes the shape of an oblong protuberance is provided inside the hold section 64. The translucent cover 12 is held while fitted to the translucent cover hold section 64, and the translucent cover 12 is pressed and supported from the behind by a rear support section 64*a*. As will be described later, the element support 60 can be connected to the guide support 70 by means of the fitting structure. At the time of connection, the front side of the translucent cover 12 is pressed and supported by a front support section (not shown) that is provided on the guide support 70 and that is identical with the rear support section 64*a* in terms of a size and a shape. The translucent cover 12 is thereby held in all directions without involvement of a rattle.

As shown in FIG. 7, a light source hold section 65 for holding the test light source 13 is made on the back of the pedestal 61 adjacently to each of the element housing recesses 63 and 63. The light source holding section 65 is opened in close proximity to the circuit board 30 while oriented in an oblique direction. The test light source 13 positioned on the front side of the circuit board 30 is inserted into the opening of the light source hold section 65 while its leads are bent; and is held while fitted to the inside of the light source hold section and held in a fixed orientation. The light source hold section 65 has a penetration from its opening to a space above the element housing recesses 63 and 63 that corresponds to the inside (the rear surface side) of the translucent cover 12; and makes it possible to cause light to pass through the translucent cover 12 according to a held angle of the test light source 13, to thus emit light in a front forward direction. The angle at which the light source hold section 65 holds the test light source 13 will be described in detail later.

As shown in FIG. 8, two attachment arms 66 and 66, which extend down toward the circuit board 30 and are to be attached to the same, are made at diagonal positions on the back of the pedestal 61 with the respective element housing recesses 63 and 63 interposed therebetween. The attachment arms 66 and 66 are plate-shaped elements that extend along the X-axis direction. Engagement projections 66*a* and 66*a* projecting in opposite directions are made at leading ends of the respective attachment arms. Meanwhile, slit-shaped engagement holes 32 and 32 penetrating through a plate surface are made in the circuit board 30, thereby enabling insertion of the leading ends of the respective attachment arms 66 and 66. Specifically, when the element support 60 is attached to the circuit board 30, the leading ends of the attachment arms 66 and 66 are inserted into the respective engagement holes 32 and 32. At that time, the respective attachment arms 66 and 66 are deflected in a direction opposite to a projecting direction of the engagement projections 66*a* and 66*a*. When the engagement projections 66*a* and 66*a* have come to the rear surface side of the circuit board 30, the attachment arms 66 and 66 are restored to their original shapes by virtue of their elasticity. The engagement projections 66*a* and 66*a* are thereby fastened to edges of the respective engagement holes 32 and 32. Since the engagement projections 66*a* and 66*a* project in opposite directions at this time, elastic force acts on the engagement projections so as to hold each other. Thus, the attachment arms are prevented from undergoing removal unless otherwise the engagement projections 66*a* are intentionally actuated in a receding direction. Further, respective end faces of the previously-described respective pillars 62 remain in abutment on the front side of the circuit board 30, so that rattling of the element support 60 is prevented.

As shown in FIG. 7, two attachment arms 67 at one position and one attachment arm 67 at the other position are made at diagonal positions along side edges of the front side of the pedestal 61 with the respective element housing recesses 63 and 63 are sandwiched therebetween, wherein each of the attachment arms 67 is to be attached to the guide support 70 standing upright toward the front. Each of the attachment arms 67 is a plate-shaped element that extends along the X-axis direction, and engagement projections 67*a* projecting in mutually-opposing directions are made at the respective leading ends of the attachment arms. Meanwhile, slit-shaped engagement holes 714 penetrating through a flat surface of the guide support are made at three corresponding positions on the guide support 70, thereby enabling attachment of the leading ends of the respective attachment arms 67. When, the element support 60 and the guide support 70 are joined together, the leading ends of the attachment arms 67 are inserted into respective engagement holes 714 from the back of the guide support 70. At this time, the respective attachment arms 67 are deflected in a direction opposite to the projecting direction of the engagement projections 67*a*. When the engagement projections 67*a* have reached the front side of the guide support 70, the attachment arms 67 are restored to their original states by virtue of their elasticity. The engagement projections 67*a* are thereby fastened to edges of the respective engagement holes 714. Since the engagement projections 67*a* project in opposite directions at this time, elastic force acts on the engagement projections so as to hold each other. Thus, the attachment arms are prevented from undergoing removal unless otherwise the engagement projections 67*a* are intentionally actuated in a receding direction. Further, an upper surface of the pedestal 61 of the element support 60 and a rear surface of the guide support 70 remain in close contact with each other, so that rattling of the element supports 60 and 70 is prevented.

(Main Light Source)

The main light source 11 is an LED fixedly mounted on the circuit board 30 so as to emit light in a front forward direction and provided in number of two. Such main light sources 11 are used for various applications. For instance, the light sources remain extinguished in ordinary times and illuminated when flames are detected, to thus send a notice to the environment. When a plurality of flame detectors 10 are connected to the receiver and when there is a response request intended for one of the detectors, a response is made by means of the main light source of the flame detector 10, which is a target of response, being switched to a blinking state.

(Light Guide Member)

Figure 10:
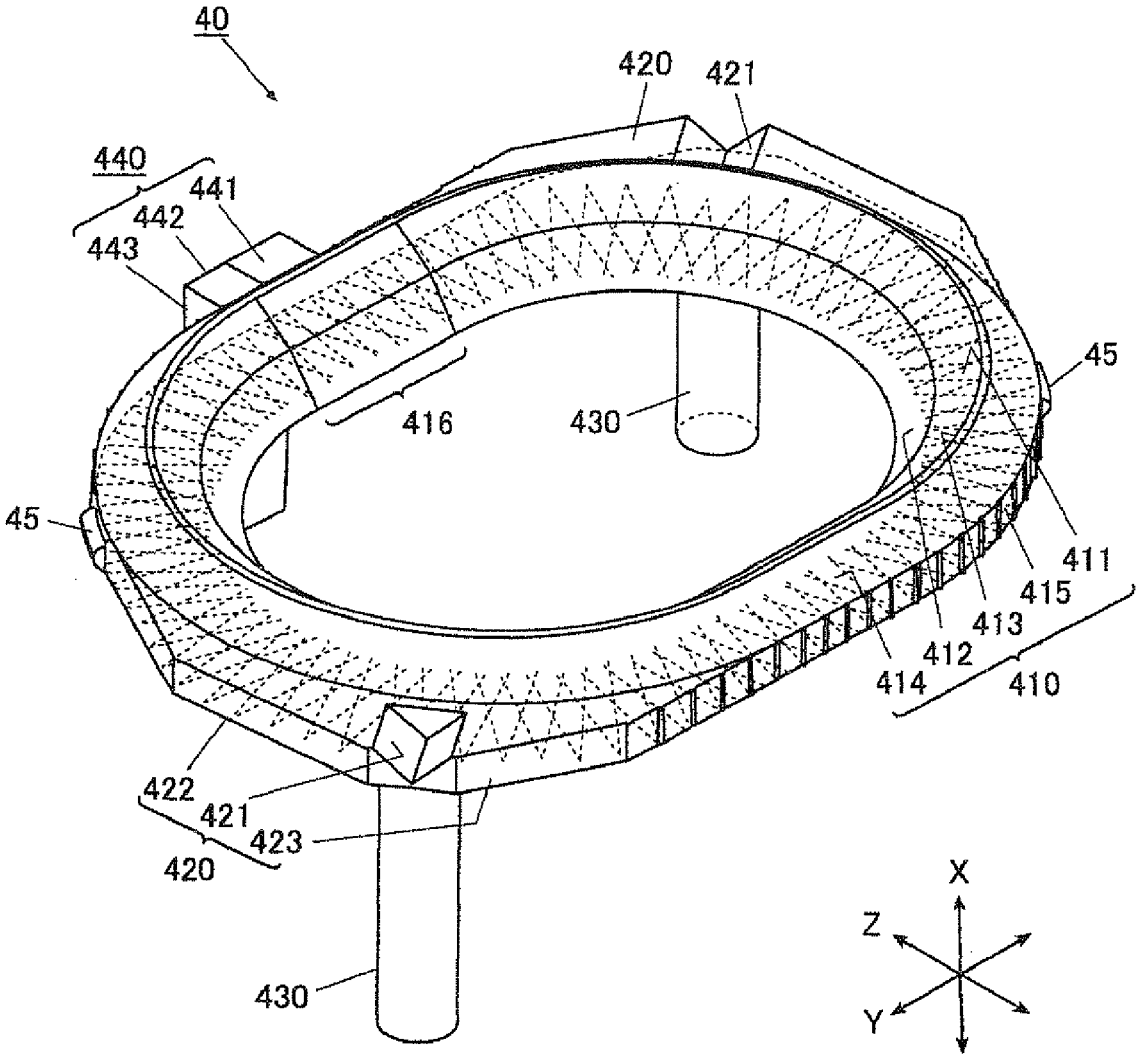
FIG. 10 is a perspective view showing the entirety of a light guide member.
Figure 11:
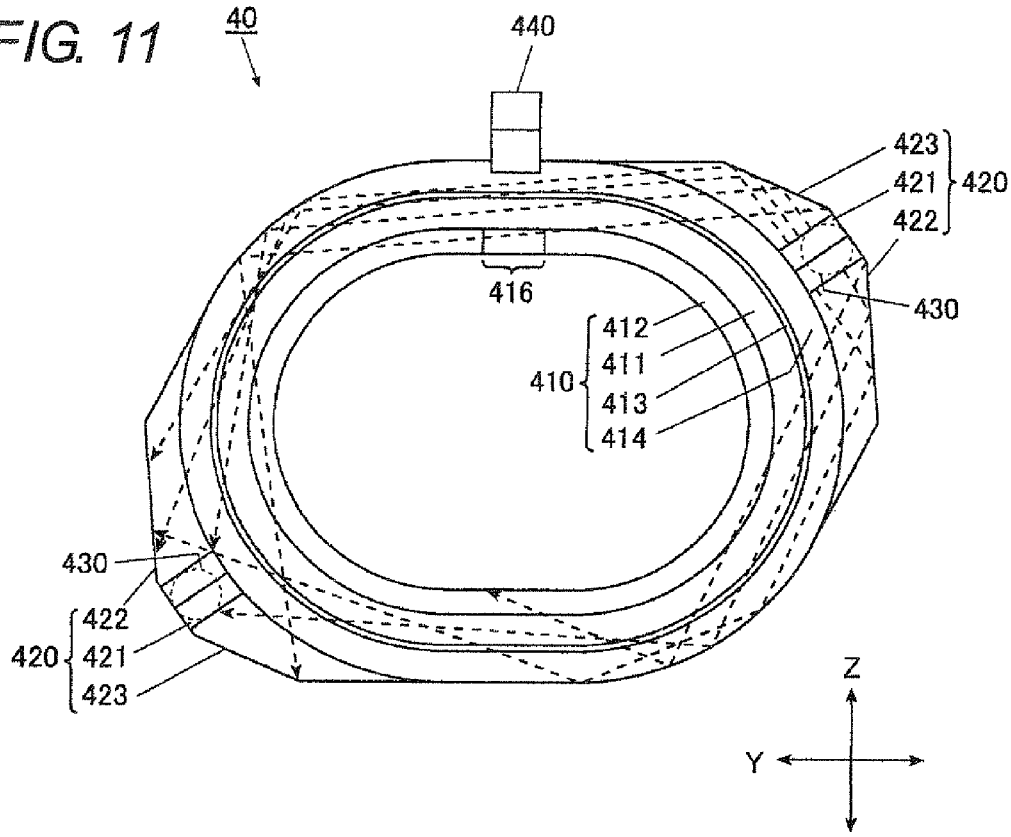
FIG. 11 is a front view of the light guide member.
Figure 12:
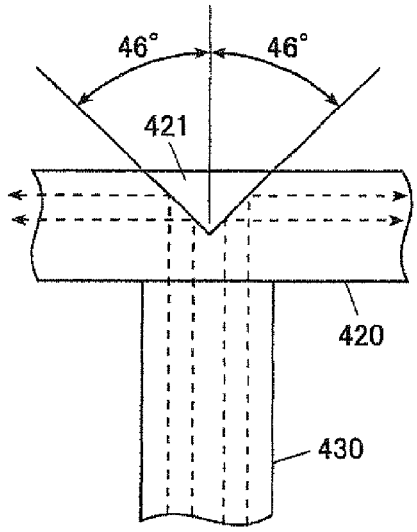
FIG. 12 is a partially-enlarged view of the light guide member.

FIG. 10 is a perspective view showing the entirety of the light guide member 40; FIG. 11 is a front view of the light guide member 40; and FIG. 12 is a partially-enlarged view of the light guide member 40.

The light guide member 40 is fixedly held in the housing 20 by means of the guide support 70 which will be described later. Accordingly, a relative positional relationship between respective sections of the light guide member 40, which will be described below, and a configuration other than the light guide member 40 is based on the premise that the light guide member 40 is secured to a fixed position by way of the guide support 70.

The light guide member 40 has a light emission section 410 that assumes a substantially annular oblong shape when viewed from the front and that has a first interior slope 411 and a second interior slope 412 serving as light emitting planes for emitting light from the front of the housing 20; two first light guide sections 420 outwardly extending from the light emission section 410; two second light guide sections 430 perpendicularly extending down from the respective first light guide sections 420 toward the circuit board 30 along the X-axis direction; and a third light guide section 440 for guiding the test light exited from the test light source 13 to the test light receiving element 14. These sections are integrally molded from a translucent resin. Specifically, the light guide member 40 enables internal propagation of light.

The shape of the light emission section 410 captured when viewed from the front is made in an oblong shape analogous to the shape of the opening 214 of the cover element 211 of the housing 20. The first interior slope 411 and the second interior slope 412 of the light emission section 410 are arranged so as to face the outside by way of the opening 214.

The two first light guide sections 420 are made at diagonal positions on an outer circumferential surface (an outer edge) of the oblong light emission section 410, so as to project to the outside. Rear surfaces of the respective first light guide sections 420 and a rear surface of the light emission section 410 are continually flush with each other along a Y-Z plane. A minute structural section (illustrated in hidden lines in FIG. 10) made of myriad streaky projections is made over substantially all rear surfaces of the light emission section 410 and the first light guide sections 420. The minute structural section exhibits an effect of reflecting light traveling toward the rear surface side by means of irregularities, to thus emit light from the first and second interior slopes 411 and 412 serving as the front-side light emission surfaces.

The respective first light guide sections 420 each are made into the shape of a plate having a uniform thickness in the X-axis direction. The columnar second light guide section 430 is made on each of the rear surface sides of the respective first light guide sections so as to extend downwardly along the X-axis direction.

An end face on the rear surface side of each of the second light guide sections 430 is a smooth surface extending along the Y-Z plane. As shown in FIG. 9, the second light guide sections are positioned opposite and in close proximity to the respective main light sources 11 mounted on the front surface of the circuit board 30. The end faces work as entrance planes for light exiting from the main light sources 11.

As shown in FIG. 12, a notch 421 assuming a V-shaped cross-sectional profile is made at a position on each of the first light guide sections 420 where the first light guide section faces the front-side end of the second light guide section 430. An open angle (an interior angle) of the notch 421 is set to 92°, and two mutually-opposing planes which form an inclination of 46° with respect to the X-axis direction are made by the notch 421. By means of the two mutually-opposing planes, the light traveling through the inside of the second light guide section 430 can be reflected in directions substantially parallel to respective flat planes of the first light guide section 420 on both sides of the second light guide section 430.

The open angle (the interior angle) of the notch 421 is set to 92° as mentioned above, and the two flat planes are made symmetrical about the direction extending along the second light guide section 430. Reflected light is reflected in a direction slightly closer to the rear surface side than to the flat planes of the first light guide section 420. The foregoing minute structural section is made on the rear surfaces of the first light guide sections 420 and the rear surface of the light emission section 410. Hence, in the course of traveling from the second light guide section 430 to the first light guide section 420 and the light emission section 410, light is effectively reflected toward the front side, whereby the first and second interior slopes 411 and 412 can entirely, effectively be illuminated. In view of a trade-off between effective illumination of the first and second interior slopes and transmission of light to a further distant location from the second light guide section 430, the open angle of the notch 421 is preferably 92° but may also range from 90° to 95°.

When viewed from the front, each of the first light guide sections 420 has two reflection planes 422 and 423 that are parallel to the X-axis direction and that reflect light beams reflected in two directions by the notch 421 so as to travel along a tangential direction of the oblong shape of the light emission section 410. By means of the reflection surfaces 422 and 423, reflected light propagates along the oblong shape of the light emission section 410 when viewed from the front, to thus reach a further distant location, so that the entire light emission section 410 can be effectively illuminated.

All of the first light guide sections 420 and the second light guide sections 430 are arranged so as to be covered with the cover element 210 of the housing 20, and the opening 214 is also invisible from the outside. Depending on a structure for joining the first light guide sections 420 to the second light guide sections 430, light sometimes rectilinearly travels through the second light guide sections 430, to thus intently pass through the first light guide sections 420. However, since the light guide sections 420 and 430 are covered with the cover element 210, uneven illumination, such as partially intensive illumination, of the light guide member 40, which would otherwise be caused by transmitted light, can be avoided from being viewed from the outside.

The light emission section 410 is a substantially-annular shape, such as an oblong shape, whose center is widely opened, and a cross-sectional profile taken by cutting a section of the annular shape is a bell shape having a convex in its front forward direction. In the light emission section 410, an area 413 corresponding to a crest of the bell shape continually extends along the oblong. The first interior slope 411 is made over a perimeter of the crest and immediately inside the crest 413, and the second interior slope 412 is made over the perimeter and inside of the first interior slope 411. Further, an exterior slope 414 is made over the perimeter of and outside the crest 413.

The crest 413 of the light guide member 40 is of the same size as that of an inner edge of the opening 214 of the cover element 210 of the housing 20. The light guide member 40 is arranged in such a way that the crest 413 matches the opening 214. Accordingly, only the first interior slope 411 and the second interior slope 412 are visible through the opening 214, and the exterior slope 414 is invisible.

The first interior slope 411 is inclined so as to have a descent inclination toward the main detection light receiving elements 50 and 50. Since such a descent inclination is made over the perimeter of the first interior slope, the entire first interior slope 411 assumes an oblong conical shape. The second interior slope 412 located inside the first interior slope 411 likewise assumes a conical shape. As shown in FIG. 8, the descent inclination of the second interior slope 412 is steeper than the descent inclination of the first interior slope 411.

Specifically, the first interior slope 411 is arranged so as to limit an angular field of view for the respective main detection light receiving elements 50 situated at the interior center position. The angular field of view of each of the main detection light receiving elements 50 used in the flame detector 10 is preferably set in such a way that an angle of inclination with respect to the direction of a center line of the angular field of view (the main detection light emitting element is arranged along the X-axis direction) assumes a value of 50° in every direction. In short, so long as the angle of inclination falls within the range of angular field of view, substantially equal accuracy of radiation detection can be maintained in every direction. For this reason, the first interior slope 411 is set in such a way that the angle of inclination assumes a value of 50° with respect to the X-axis direction over the perimeter of the slope. The first interior slope 411 is positionally set in such a way that, when a cone whose point angle achieved with reference to the center line is 50° is positioned upside down with respect to each of the main detection light receiving elements 50 and 50 and when an apex of each of the cones comes to the position of each of the main detection light receiving elements 50 and 50, the first interior slope 411 makes a surface contact with each of the conical surfaces. Accordingly, the first interior slope 411 implements a function of limiting the angular fields of view of the respective main detection light receiving elements 50 and 50.

Meanwhile, since the second interior slope 412 is steeper than the first interior slope 411, the second interior slope 412 falls outside the range of angular fields of view of the respective main detection light receiving elements 50 and 50. A section of the entire circumference of the second interior slope 412 serves as an entrance section 416 for test light from the test light source 13. The orientation of the test light source 13 is held by the element support 60 in such a way that test light is emitted toward the entrance section 416 serving as a predetermined position on the second interior slope 412. Meanwhile, the angle of inclination of the second interior slope 412 is uniformly set so as to become equal to the angle of inclination of the entrance section 416. The angle of inclination of the entrance section 416 is set to an angle at which the test light from the test light source 13 does not undergo reflection as well as to an angle of inclination at which the direction of an optical axis of the test light from the test light source 13 inclined with respect to the Z-axis direction becomes parallel to the Z-axis direction by means of refracting action of the entrance section 416.

Only the entrance section 416 may also be given the angle of inclination meeting the foregoing requirements, and the entirety of the second interior slope 412 except the entrance section 416 may also be set to another angle of inclination. In that case, indentations arise in the interior slope at boundaries between the entrance section 416 and the other area. The indentations are likely to induce accumulation of stains and make it difficult to clean the stains. For these reasons, the perimeter of the second interior slope 412 is set to the angle of inclination equal to the incident angle 416 so as to prevent occurrence of indentations.

The first and second interior slopes 411 and 412 are subjected to graining as processing for preventing occurrence of reflection on a surface. As mentioned, the first interior slope 411 has a function for limiting the angular fields of view of the respective main detection light receiving elements 50. Such a limitation on the angular field of view is performed for limiting a range where the main detection light receiving element 50 can maintain, on its front side, predetermined accuracy of detection in every direction around the optical axis. If the first and second interior slopes 411 and 412 are likely to cause reflection, light reflected from these interior slopes 411 and 412 also enters the light receiving plane, which induces variations in detection accuracy from one direction to another. Therefore, the first and second interior slopes 411 and 412 are subjected to graining, thereby inhibiting occurrence of variations in detection accuracy achieved in every direction.

Only the entrance section 416 for test light is not subjected to graining and keeps a transparent state, thereby assuring detection accuracy for a test.

As mentioned above, the light emission section 410 is arranged in such a way that the crest 413 coincides with the inner edge of the opening 214 of the cover element 210, so that only the first and second interior slopes 411 and 412 emit light to the outside by way of the opening 214.

Figure 13:
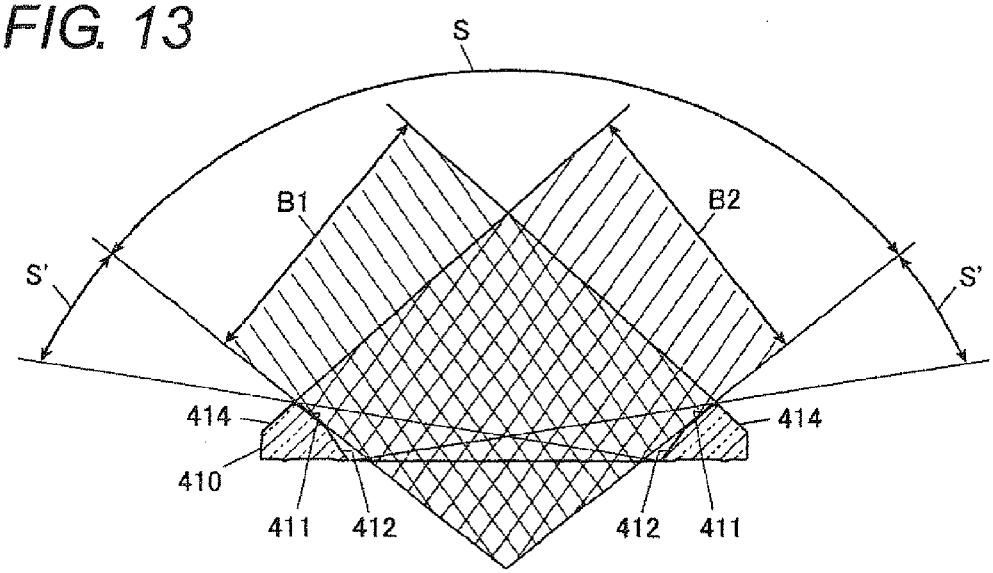
FIG. 13 is a descriptive view showing a relationship between a visually ascertainable range and a monitoring range when interior slopes of the light guide member are illuminated.

Thus, when a case where the annular first and second interior slopes 411 and 412 are illuminated is compared with a case where the exterior slope 414 is illuminated, areas where the exterior slope 414 on one side is not visible as indicated by oblique lines B1 and B2 arise within a range S of the angular field of view of the main detection light receiving area 50, as shown in FIG. 13. In an overlapping area between the regions B1 and B2, none of the exterior slopes 414 on both sides become visible.

However, as in the flame detector 10, when the first and second interior slopes 411 and 412 are illuminated, such dead spaces do not arise in the range S of the angular field of view.

Specifically, it is possible for a person in the monitoring range of the flame detector 10 to be able to ascertain display light more reliably, to thus enable enhancement of visibility.

Moreover, visibility can be assured from areas (S' and S' shown in FIG. 13) other than the monitoring area (S in FIG. 13), and an illuminated state can be viewed from substantially every direction from the main detection light receiving elements.

Figure 14A:
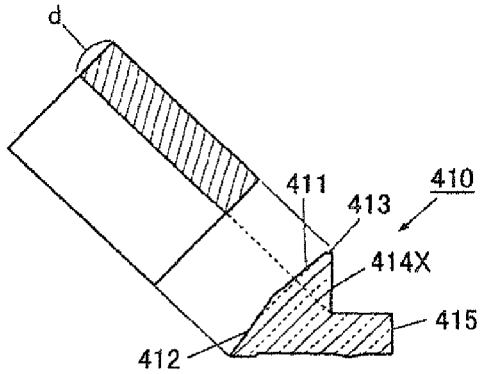
FIG. 14A is a descriptive view showing an illuminated state of the interior slopes achieved when a rear slope is not provided on the light guide member.

Incidentally, the light guide member 40 is integrally formed by pouring a transparent resin into a mold. In this case, as the thickness of respective sections of the light guide member is reduced, fondling the light guide member usually becomes easier. From the viewpoint of an advantage of molding, it is preferable to realize a thin plate structure by providing the outside of the crest 413 of the light emission section 410 with a step 414X, as shown in FIG. 14A. However, in that case, when an illuminated state is observed from the respective interior slopes 411 and 412, the step 414X blocks scattered light originated from the rear surface side where the minute structure section is provided, so that the step blocking the light from the rear darkens illumination (a region designated by reference symbol "d" shown in FIG. 14A).

Figure 14B:
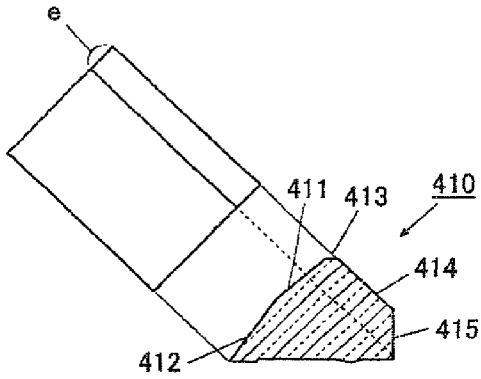
FIG. 14B is a descriptive view showing an illuminated state of the interior slopes achieved when the rear slope is provided on the light guide member.

Meanwhile, when an exterior slope 414 is provided outside the crest 413 of the light emission section 410, scattered light originated from the rear surface side where the minute structure section is provided is not blocked as shown in FIG. 14B, so that a superior illuminated state can be assured.

As shown in FIG. 14B, when the exterior slope 414 is provided on the outer circumference side of the light emission section 410, a side end face 415 on an outer region of the light emission section 410 is sometimes clearly seen through the interior slopes 411 and 412 depending on an angle of view. For this reason, a minute structure section made of streaky projections is made on an outer-region-side end face of the light emission section 410 (and a side end face except the reflection planes 422 and 423 of the first light guide sections 420) as in the case with the rear section. As a result, even when the side end face 415 is clearly seen through the interior slopes 411 and 412, scattered light is generated as in the case of the rear surface, so that an area designated by reference symbol "e" of FIG. 14A does not become darker than the rear surface.

In FIG. 10, reference numeral 45 provided on the side end face 415 of the light emission section 410 designates engagement projections to be engaged with recesses provided on the guide support 70 when the light guide member 40 is attached to the guide support 70 to be described later.

The third light guide section 440 is for guiding the test light entered from the test light entrance section 416 to the test light receiving element 14 on the circuit board 30. The third light guide section has a first transmission section 441 that is arranged at a position where light is cast from the entrance section 416 along the Z-axis direction and that extends outside from the light emission section 410 along the Z-axis direction; a reflection plane 442 for reflecting light traveling through the inside of the first transmission section 441 in the Z-axis direction toward the X-axis direction; and a second transmission section 443 extending from the reflection plane 442 toward the circuit board 30 along the X-axis direction.

The first transmission section 441 is a columnar element that has a square cross-sectional profile and that extends along the Z-axis direction, and the second transmission section 443 is a columnar element that has a square cross-sectional profile and that extends along the X-axis direction. The reflection plane 442 is situated at an intersection between the first transmission section 441 and the second transmission section 443 and that is made up of a smooth plane realized by inclining the Y-Z plane at an angle of 45° with respect to the Y-axis direction.

Further, a rear side end face of the second transmission section 443 is positionally set so as to face up to the test light receiving element 14 on the circuit board and is extended so as to become close to the circuit board 30. An extended leading end of the second transmission section 443 is made in a flat surface perpendicular to the optical axis of the test light receiving element 14, and the flat surface serves as a test light exit section 444.

(Test Light Source and Test Light Receiving Element)

The test light source 13 is an LED, and the test light receiving element 14 is a photodiode and takes wavelength light emitted from the test light source 13 as a light receiving band. Leads of the test light source 13 and those of the test light receiving element 14 are connected directly to the circuit board 30 without involvement of a socket.

Since the test light source 13 and the test light receiving element 14 are arranged in close proximity to each other on the circuit board 30, they are situated on the rear surface side than to the translucent cover 12. Since the second transmission section 443 extends from the front side to the rear surface side of the translucent cover 12, the test light source 13 and the test light receiving element 14 do not need to be positioned with the translucent cover 12 sandwiched therebetween.

(Guide Support)

As shown in FIGS. 4 and 7, the guide support 70 has a substantially-disc-shaped pedestal 71 arranged along the Y-Z plane in the housing 20 and a circumferential wall 72 standing up from an outer edge of the pedestal 71 toward the rear surface side. The circumferential wall 72 assumes a cylindrical shape, and an inside diameter of the circumferential wall 72 is set so as to become slightly larger than an outside diameter of the pedestal 61 of the element support 60. The guide support 70 can be joined to the element support 60 while accommodating the element support 60.

An oblong indentation 711 is made in the front center of the pedestal 71, and an oblong opening 712 is made in a bottom of the indentation 711. The opening 712 is in mutual communication with the respective main detection light receiving elements 50.

A fitting section 713 congruent with the shape of the light guide member 40 achieved when viewed from the front is made in the front side of the pedestal 71. The fitting section 713 is made up of a projection standing upright on the front surface of the pedestal 71. The light guide member 40 is fitted to an area surrounded by the projecting fitting section 713, whereby the light guide member 40 can be fastened. Unillustrated indentations that engage with the engagement projections 45 are made inside the fitting section 713, whereby the light guide member 40 is fixed. Moreover, as shown in FIG. 4, two engagement projections 713*a* projecting toward the opening 712 are made at each of two locations inside the fitting section 713 with the opening section 712 interposed therebetween. Rattling of the fixed light guide member 40 is prevented by means of the engagement projections.

In a state where the light guide member 40 is fixed to the fitting section 713, the indentation 711 has interior slopes 711*a* and 711*b* that entirely make up a substantially-conical shape along with the two interior slopes 411 and 412 of the light guide member 40. The interior slope 711*b* located close to the main detection light receiving element 50 makes up a conical surface that is substantially identical with the first interior slope 411 of the light guide member 40. Further, the other interior slope 711*a* is set so as to have an inclination that is lower than that of the interior slope 711*b*, thereby preventing occurrence of an interference with the angular field of view defined by the first interior slope 411 of the light guide member 40 and the interior slope 711*b*.

An inner edge of the second interior slope 412 of the light guide member 40 and an outer edge of the interior slope 711*a* of the indentation 711 are set so as to assume oblong shapes that are identical with each other in terms of a size and a shape. The interior slopes 412 and 711*a* differ from each other in terms of an angle of inclination. However, as a result of the interior slopes being made identical with each other in size as mentioned above, a step between the interior slopes can be eliminated, thereby preventing accumulation of stains and making it easy to perform cleaning.

A front support section (omitted from the drawings) provided in correspondence to the rear support section 64*a* of the foregoing element support 60 is made on right behind the opening 712 of the indentation 711. The element support 60 and the guide support 70 are connected together, whereby the translucent cover 12 can be sandwiched by the supports.

As shown in FIGS. 2 and 7, slit-shaped engagement holes 714 into which the leading ends of the three attachment arms 67 of the element support 60 are to be inserted are drilled in diagonal positions on the pedestal 711 with the opening 712 sandwiched therebetween. When the guide support 70 and the element support 60 are connected together, the pedestal 61 of the element support 60 is inserted into the circumferential wall section 72 of the guide support 70 from behind, and the respective attachment arms 67 are inserted into the corresponding engagement holes 714, and the respective engagement projections 67*a* are engaged with front sides of the respective engagement holes 714.

Two cylindrical structures 715 into which the two second light guide sections 430 of the light guide member 40 are to be inserted and a square cylindrical structure 716 into which the second transmission section 443 of the light guide member 40 are to be inserted are provided on the back of the pedestal 71 so as to extend toward the circuit board 30.

Since the surfaces of the respective second light guide sections 430 and the surface of the second transmission section 443 (except the end face) are covered with the cylindrical structures 715 and 716 made of a white resin, and hence, during transmission of light, the light guide member 40 can reflect to the inside the light transmitting from the surface of the light guide member 40 to the outside.

The entire rear surface of the light guide member 40 remains in contact with the front side of the pedestal 71, and the entire side end face of the light guide member 40 is in contact with the fitting section 713. Therefore, the light transmitting form the rear surface and side end face of the light guide member 40 to the outside of the light guide member 40 can be reflected to the inside.

Even when the guide support 70 is built in the housing, the exterior slope 414 of the light guide member 40 and the front surface of the first light guide section 420 are made so as to assume an interior shape by means of which an interior surface of the cover element 210 of the housing 20 contacts the slope and the front surface.

Specifically, the light guide member 40 can cause the light from the main light source 11 to travel to the respective interior slopes 411 and 412 without an escape of light to the outside, whereby efficient illumination is possible.

Likewise, the light guide member 40 can efficiently propagate the light from the test light source 13 to the test light receiving element 14.

As shown in FIG. 4, protrusions 721 (one of them is omitted from the drawings) extending on all sides in an outward radial direction are formed along a rear-side edge of the circumferential wall section 72. Each of the protrusions 721 is arranged so as to fit an unillustrated recess in the rear surface side of the cover element 210 of the housing 20. Rattles of the guide support 70, rattles of the element support 60 connected thereto, and rattles in the respective main detection light receiving elements 50 achieved in their radial directions can be prevented.

(Circuit Board)

The main light source 11, the test light source 13, and the test light receiving element 14 are mounted in the vicinity of the surface of the circuit board 30, and the main detection light receiving elements 50 and 50 are mounted by way of the element support.

Moreover, various electronic components and a microcomputer for causing the flame detector 10 to perform predetermined operations are mounted on the circuit board 30.

Principal processing performed by the circuit board 30 is hereinbelow described.

First, the circuit board 30 performs flame detection processing. The respective main detection light receiving elements 50 periodically detect infrared radiation at two wavelengths (e.g., 4.0 [μm] and 4.4 [μm]) through flame detection processing, thereby determining detection intensity of the respective main detection light receiving elements 50 and 50. When detection intensity achieved at each of the wavelengths is determined to fall within a range of a preset value unique to combustion of flames, the circuit board 30 outputs a detection signal to the receiver. When the receiver determines that flames are detected and when a report signal is transmitted, the circuit board 30 switches the two main light sources 11, which have held in an extinguished state, to an illuminated state, and occurrence of flames is notified to the environment of the flame detector 10 by means of blinking.

The circuit board 30 also performs a translucency test for detecting stains on the translucent cover 12. For instance, the test light source 13 is periodically illuminated through processing, thereby determining whether or not the intensity of the test light receiving element 14 for detecting test light is a threshold level or more set for determining stains. When the determination result is less than the threshold level, a signal pertaining to detection of stains on the translucent cover 12 is output to the receiver.

First, the circuit board 30 performs self-test processing for determining whether or not the respective main detection light-receiving elements 50 and 50 are normal. For instance, the heater elements incorporated in the respective main detection light receiving elements 50 are periodically heated through processing, thereby determining whether or not detection intensity of the piezoelectric elements of the respective main detection light receiving elements 50 is a threshold level or more that is for determining an anomaly. When the detection intensity that is less than the threshold level is found in any of the main detection light receiving elements, a signal pertaining to occurrence of an anomaly in the main detection light receiving element is output to the receiver. The circuit board 30 acts as self-test control means through processing.

Working-Effects of Embodiment of the Invention

In the flame detector 10 made up of the foregoing configuration, the light guide member 40 has the oblong light emission section 410. Hence, it becomes possible to visually ascertain an illuminated state from every direction. Since the light emission section does not need to project, an attempt can be made to miniaturize the flame detector in the X-axis direction.

The first interior slope 411 of the light guide member 40 has the function for limiting the angular field of view of each of the main detection light receiving elements 50. Specifically, the angular field of view of the main detection light receiving element 50 is specified, whereby scheduled detection accuracy for every direction can be fulfilled. Occurrence of variations in accuracy, which would otherwise arise from one direction to another, can be prevented.

Moreover, the light guide member 40 has the test light entrance section 416 and the third light guide section 440, and the test light received ahead of the translucent cover 12 is propagated to a position behind the translucent cover 12. Hence, both the test light source 13 and the test light receiving element 14 can be mounted directly on the circuit board 30. A member and a structure for placing either of the two ahead of the translucent cover 12 are obviated, to thus enable a reduction in the number of components from this viewpoint.

Moreover, as mentioned above, the light guide member 40 realizes, by means of one member, all of the functions for ascertaining an illuminated state from every direction, for limiting the angular field of view of the main detection light receiving element 50, and for propagating test light. Even from the viewpoint, an effective reduction in the number of components is realized.

The light guide member 40 emits light from the respective interior slopes 411 and 412 of the light emission section 410 to the outside of the housing. Therefore, a problem of occurrence of in the range of angular field of view of the main detection light receiving element 50, an area where an illuminated state cannot be visually ascertained or a range where a section of the annular is invisible, which would arise when an exterior slope is illuminated, can be avoided. An annular illuminated state can be ascertained within the range of angular field of view from every position, so that an attempt can be made to enhance visibility.

It is also possible to assure visibility even from the areas (S' and S' in FIG. 13) other than the monitoring area (S in FIG. 13), and an illuminated state can be seen from substantially every direction centering on the main detection light receiving elements.

Since the exterior slope 414 is disposed outside the first and second interior slopes 411 and 412 that emit light to the outside of the housing and since the minute structure is provided on the rear surface and side end face of the light guide member 40, the light guide member 40 can uniformly maintain the state of light emitted from the respective interior slopes 411 and 412 and enables performance of superior light emission.

Further, in the light guide member 40, a connection between the first light guide section 420 and the second light guide section 430 is hidden inside by the cover element 120 of the housing 20, and hence the connection that is brighter than the other area and that is likely to emit light can be hidden from the outside. Thus, the entire light emission section 420 can be uniformly illuminated.

Since the notch 421 having a V-shaped cross sectional profile is made at a position opposite the front side end of the second light guide section 430, and the open angle of the notch is set to 92°, the light guide member 40 enables propagation of light to a position further distant from the light emission section 410 through the first light guide section 420. Occurrence of scattered light, which will be caused by the minute structure section on the rear surface, is induced, so that the interior slopes 411 and 412 can be uniformly illuminated much brighter.

In the flame detector 10, the guide support 70 holds the light guide member 40; the guide support 70 can be connected to the element support 60; and the element support 60 can be implemented on the circuit board 30. The translucent cover 12 can be fixedly sandwiched between the element support 60 and the guide support 70. Therefore, as shown in FIG. 5, the light guide member 40, the guide support 70, the translucent cover 12, the main detection light receiving element 50, and the element support 60 can be assembled on the circuit board 30, whereby the flame detection unit 100 is built. When the flame detection unit 100 is in an assembled state, the main detection light receiving elements 50 can be brought into the same light receiving environment as that achieved as a result of completion of the flame detector 10 (e.g., the light guide member 40 limits the angular field of view, and external light is received by way of the translucent cover 12).

Accordingly, in the processes for manufacturing the flame detector 10, a final operation test can be performed in the assembled state shown in FIG. 5. Even when a test result has brought about a necessity for reinspection, disassembly of the housing 20 is obviated, and it becomes possible to expedite manufacturing processes and enhance productivity.

Since the respective main detection light receiving elements 50 are equipped with the heat sources and since the detection functions of the main detection light receiving elements 50 can be tested by heating the heat sources, the flame detector 10 can readily detect an anomaly in the elements and effectively avoid occurrence of a detection failure.

(Another Example Embodied by UV Detection Element)

Figure 15:
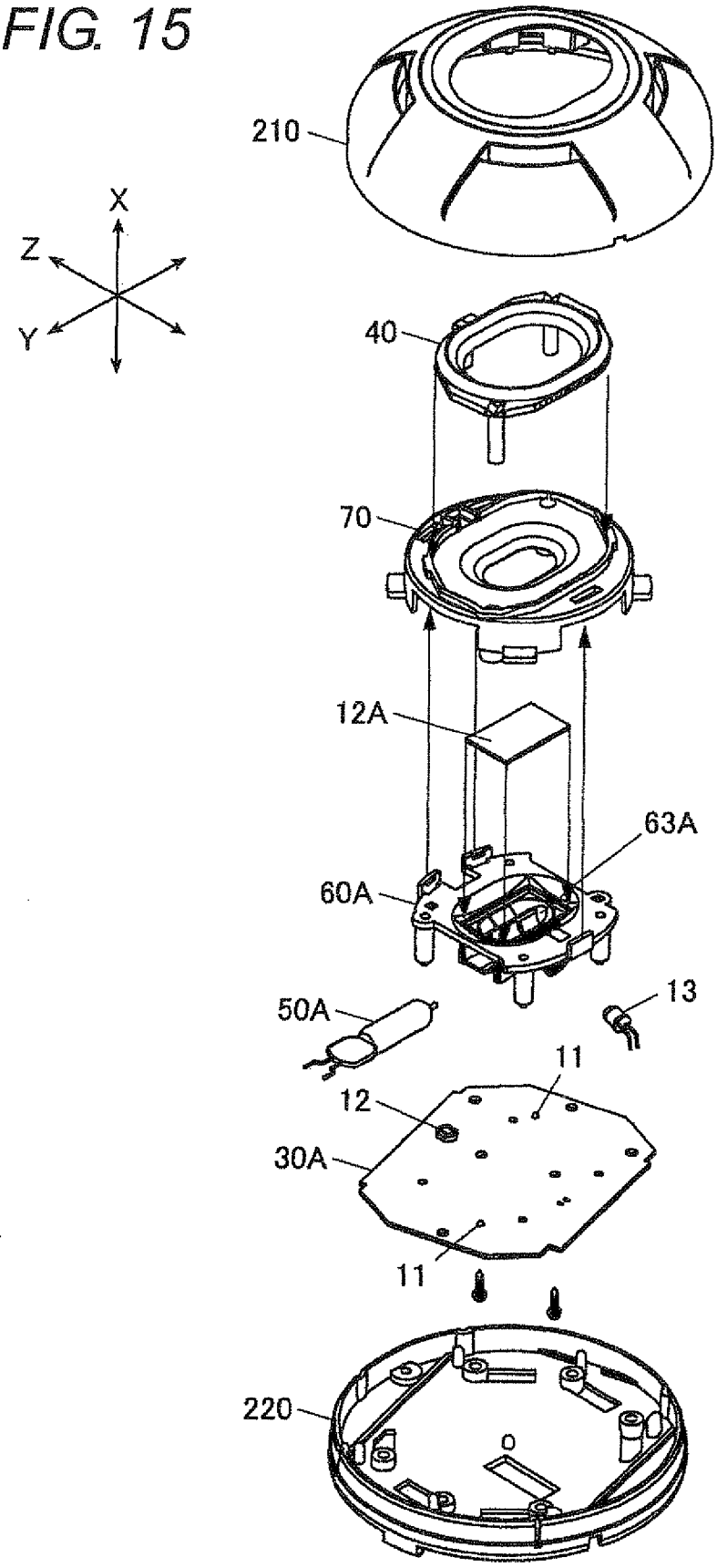
FIG. 15 is an exploded perspective view of a flame detector achieved when a UV radiation detection element is used as a main detection light receiving element.

The main detection light receiving elements of the flame detector 10 are not limited to the elements that detect infrared radiation. For instance, as shown in FIG. 15, a main detection light receiving element 50A made up of a UV radiation detection element may also be used.

In that case, a circuit board 30A must have circuit capable of detecting flames by mean of the main detection light receiving elements 50A made up of a UV radiation detection element. However, it is preferable to make structures for fitting and fixing the circuit board 30A into the housing 20 identical with the structures of the circuit board 30 and to arrange the main light sources 11 and 11 and the test light receiving element 14 in the same manner as in the circuit board 30.

Moreover, the main detection light receiving element 50A that detect UV radiation singly detects flames, and is used while an elongated tubular element is laid along the Y-axis direction. Therefore, only one element housing recess having a fitting structure that allows insertion of the main detection light receiving element 50A from side is made as an element housing recess 63A of an element support 60A. It is preferable to design the element support 60A so as to become identical with the element support 60 in terms of a structure and a size except the structure for connecting an element fitting recess 63A of the element support 60A (pillars 62A and the like) and the circuit board 30A.

The translucent cover 12A is not sapphire glass but preferably be made of a material that readily permits transmission of UV radiation.

So long as the flame detector that detects flames by means of UV radiation is provided with the main detection light receiving element 50A, the element support 60A, the circuit board 30A, and the translucent cover 12A, the entire flame detector can be made common to the flame detector 10 in terms of a structure except these elements. Specifically, a commonality of the housing 20, the light guide member 40, and the guide support 70 is enabled. In a case where a flame detector that detects infrared radiation and a flame detector that detects UV radiation are produced, productivity can be enhanced.

(Others)

The test light source 13 and the test light receiving element 14 in the flame detector 10 may also be arranged in an opposite layout. In that case, the test light from the test light source 13 enters the exit section 444 at the extended leading end of the second transmission section 443 of the light guide member 40. The light exits from the entrance section 416; passes through the translucent cover 12; and is received by the test light receiving element 14.

In that case, the test light receiving element 14 must be mounted while its leads are slightly extended from the circuit board 30, in such a way that the light receiving element can fit to the element support 60. The light source hold section 65 of the element support 60 must be modified to an element hold section structured so as to allow fitting of the test light receiving element 14.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A flame detector comprising:

a housing formed with an opening at a front side thereof;

a circuit board disposed in the housing and having a circuit for detecting flames;

a first light source mounted on the circuit board and configured to emit first light;

a light guide member having a light emission portion, the light guide member comprised of translucent material and configured to guide the first light from the first light source to the light emission portion by internal propagation thereof to emit the first light from the light emission portion ahead of the housing;

a first light receiving element configured to detect second light having a predetermined wavelength unique to the flames from the opening;

a translucent cover interposed between the opening and the first light receiving element;

a second light source configured to emit third light to the translucent cover; and a second light receiving element configured to detect the third light passed through the translucent cover to test the translucency of the translucent cover, wherein the second light source and the second light receiving element are mounted on the circuit board, wherein the light emission portion is formed into a substantially annular shape which encloses the first light receiving element at the front side of the housing to limit a field of view of the first light receiving element to a predetermined range, and wherein the light guide member has a light entrance portion and a light exit portion for the third light to form a light path from the second light source to the second light receiving element through the translucent cover and the light guide member.

2. The flame detector as set forth in claim 1, wherein an entire inner periphery of the annularly shaped light emission portion is formed with an inner slope inclined toward the first light receiving element to emit the first light from the inner slope.

3. The flame detector as set forth in claim 2, wherein the light guide member is provided with a first light guide portion extended from the annularly shaped light emission portion toward the outside thereof and a second light guide portion extended from the first light guide portion toward the first light source, and wherein a connection portion between the first light guide portion and the second light guide portion is disposed to be hidden by the housing.

4. The flame detector as set forth in claim 3, wherein the first light guide portion has a flat plate shape, wherein a rear face of the light emission portion, which is opposite to a front face from which the first light is emitted and one face of the first light guide portion are flush with each other, and wherein the rear face of the light emission portion and the one face of the first light guide portion are formed with a minute structure portion including a plurality of minute grooves or minute projections.

5. The flame detector as set forth in claim 4, wherein the first light guide portion is formed with a V-shaped notch at a position opposed to one end of the second light guide portion, the V-shaped notch having two reflection faces configured to reflect the first light propagating along the second light guide portion to a direction along a flat surface of the first light guide portion, and wherein an opening angle of the V-shaped notch is greater than 90° and equal to or smaller than 95°.

6. The flame detector as set forth in claim 4, wherein an entire outer periphery of the annularly shaped light emission portion is formed with an outer slope so that a cross section of the annularly shaped light emission portion is formed into a mound shape.

7. The flame detector as set forth in claim 4, wherein an outer peripheral face of the annularly shaped light emission portion is formed with the minute structure portion.

8. The flame detector as set forth in claim 1, further comprising:

a first support configured to fix the first light receiving element with respect to the circuit board; and a second support configured to fix the light guide member with respect to the circuit board, wherein the translucent cover is fixedly sandwiched between the first support and the second support and the first support and the second support are fixed with respect to the circuit board.

9. The flame detector as set forth in claim 1, wherein the first light receiving element includes an infrared detection element provided with a heat source, wherein the heat source produces heat to run a self-test for detection function of the infrared detection element.

* * * * *